US010847922B2

(12) United States Patent
Lehmann

(10) Patent No.: US 10,847,922 B2
(45) Date of Patent: Nov. 24, 2020

(54) PLUG CONNECTOR WITH MULTIPLE CONNECTOR MODULES IN A FRAME SUPPORTED BY A SUPPORTING ELEMENT AND METHOD FOR PRODUCING THE SAME

(71) Applicant: LEONI KABEL GMBH, Nuremberg (DE)

(72) Inventor: Peter Lehmann, Absberg (DE)

(73) Assignee: Leoni Kabel GmbH, Roth (DE)

( * ) Notice: Subject to any disclaimer, the term of this patent is extended or adjusted under 35 U.S.C. 154(b) by 0 days.

(21) Appl. No.: 16/490,797

(22) PCT Filed: Feb. 16, 2018

(86) PCT No.: PCT/EP2018/053852
§ 371 (c)(1),
(2) Date: Sep. 3, 2019

(87) PCT Pub. No.: WO2018/158088
PCT Pub. Date: Sep. 7, 2018

(65) Prior Publication Data

US 2020/0161798 A1 May 21, 2020

(30) Foreign Application Priority Data

Mar. 3, 2017 (DE) ..... 10 2017 203 547

(51) Int. Cl.

| | |
|---|---|
| ***H01R 13/518*** | (2006.01) |
| ***H01R 13/514*** | (2006.01) |
| *H01R 13/506* | (2006.01) |
| *H01R 13/502* | (2006.01) |
| *H01R 13/504* | (2006.01) |
| *H01R 13/508* | (2006.01) |

(52) U.S. Cl.
CPC ..... *H01R 13/518* (2013.01); *H01R 13/514* (2013.01); *H01R 13/502* (2013.01); *H01R 13/506* (2013.01); *H01R 13/508* (2013.01); *H01R 13/5045* (2013.01)

(58) Field of Classification Search
CPC .. H01R 13/518; H01R 13/514; H01R 13/506; H01R 13/508; H01R 13/502; H01R 13/5045
USPC ..... 439/701, 607.23, 540.1
See application file for complete search history.

(56) References Cited

U.S. PATENT DOCUMENTS

| | | | | |
|---|---|---|---|---|
| 4,659,162 | A | 4/1987 | Cartesse | |
| 9,502,812 | B2 * | 11/2016 | Akagi | H01R 13/73 |
| 2004/0077197 | A1 * | 4/2004 | Nishide | H01R 13/62972 439/157 |

FOREIGN PATENT DOCUMENTS

| | | | |
|---|---|---|---|
| CN | 103001043 | A | 3/2013 |
| DE | 4305844 | A | 9/1994 |

(Continued)

*Primary Examiner* — Abdullah A Riyami
*Assistant Examiner* — Justin M Kratt
(74) *Attorney, Agent, or Firm* — Muncy, Geissler, Olds & Lowe, P.C.

(57) ABSTRACT

A plug connector having a housing, a holding frame, which is situated at least partially inside the housing and is fastened thereto, as well as a number of plug connector modules, which are held in the holding frame, at least one separate supporting element being disposed in an intermediate area between the housing and the holding frame, which supports the holding frame and thus protects it against a critical deformation.

11 Claims, 3 Drawing Sheets

(56) References Cited

FOREIGN PATENT DOCUMENTS

| | | | | | |
|---|---|---|---|---|---|
| EP | 0183587 | A1 | | 6/1986 | |
| FR | 2917906 | A1 | * | 12/2008 | ..... H01R 13/506 |
| FR | 2917906 | A1 | | 12/2008 | |

* cited by examiner

PLUG CONNECTOR WITH MULTIPLE CONNECTOR MODULES IN A FRAME SUPPORTED BY A SUPPORTING ELEMENT AND METHOD FOR PRODUCING THE SAME

This nonprovisional application is a National Stage of International Application No. PCT/EP2018/053852, which was filed on Feb. 16, 2018, and which claims priority to German Patent Application No. 10 2017 203 547.1, which was filed in Germany on Mar. 3, 2017, and which are both herein incorporated by reference.

BACKGROUND OF THE INVENTION

Field of the Invention

The present invention relates to a plug connector comprising a housing, a holding frame, which is at least partially situated inside the housing and is fastened thereto, as well as a number of plug connector modules, which are held in the holding frame. The invention also relates to a method for manufacturing a corresponding plug connector.

Description of the Background Art

In the areas of railway technology, traffic engineering, power engineering as well as plant engineering and automation, individual system parts or system modules are connected to each other for signal and/or power transmission. So-called modular plug connectors are typically used, which are adapted specifically to the corresponding system modules and are therefore not standardized, or at least provided with different designs from one system module to another system module.

SUMMARY OF THE INVENTION

It is therefore an object of the present invention to provide an advantageously designed plug connector as well as a method for manufacturing a corresponding plug connector.

A corresponding plug connector is designed, in particular, as a so-called heavy plug connector and/or as a so-called modular plug connection and is configured, for example, for use in the area of plant engineering. The plug connector comprises a housing, a holding frame, which is at least partially situated inside the housing and is fastened thereto, as well as a number of plug connector modules, which are held in the holding frame or are fixed on the holding frame. At least one separate supporting element is disposed in an intermediate area between the housing and the holding frame, which supports and/or reinforces the holding frame and thus protects it against a critical deformation.

The at least one supporting element, hereinafter referred to simply as the supporting element, is formed by a separate, additional element or component, typically an insertion part, which is not part of the housing and which is not provided for fastening the holding frame to the housing. The supporting element is furthermore preferably a component manufactured from a plastic, which is, for example, prefabricated and which is preferably introduced into the intermediate area between the housing and the holding frame and fixed therein during the manufacture of a corresponding plug connector after the plug connector modules have been inserted into the holding frame and possibly fixed on the holding frame. It does not matter whether the holding frame is first introduced into the housing, and the plug connector modules are subsequently introduced into the holding frame, or whether the plug connector modules are first introduced into the holding frame, and the holding frame, together with the plug connector modules, is then inserted into the housing.

The introduction and, if provided, the fixing of the supporting element or the supporting elements, if multiple thereof are provided, further preferably take place during a final manufacturing step, with the aid of which the manufacturing or installation of the corresponding plug connector is completed.

In addition, a corresponding supporting element, or corresponding supporting elements, may be advantageously introduced into an existing plug connector later on during a retrofit, for example also into a plug connector which is already in use. A corresponding retrofit of plug connectors having corresponding intermediate areas is also preferably carried out.

Independently thereof, a corresponding supporting element or the corresponding supporting elements is/are used to support and/or to reinforce the holding frame or individual parts of the holding frame. Due to a corresponding support and/or reinforcement, i.e. due to the introduction of the supporting element or the supporting elements, a critical deformation of the holding frame, which would result, in particular, in damage to the holding frame, is, in turn, prevented.

As mentioned above, the supporting element is preferably manufactured from a plastic or from another insulating material. The housing, in turn, is typically provided with a one-part and one-piece design and is manufactured, for example, from a plastic or from metal. Alternatively, the housing is provided with a multi-part design, the individual parts being manufactured in some cases from different materials. For example, a design of the housing is widely used, in which it comprises a housing frame, typically made from a metal, and an outer shell, made, for example, from plastic, which at least partially surrounds the housing frame. According to one design variant, this outer shell is formed by a plastic overmolding of the housing frame. The holding frame, in turn, is manufactured, for example, from a plastic or from metal and is provided in some cases with a one-part and one-piece design. Alternatively, the holding frame is provided with a multi-part design and, in particular, with a two-part design.

The housing and, in particular, the outer shell, is further preferably designed for a screw connection, locking or engagement to a mating plug connector, so that, after the formation of a corresponding plug connection, the plug connector is fixed on the corresponding mating plug connector of the plug connection via a corresponding screw connection, locking or engagement.

Independently of the design of the housing, the holding frame is preferably at least partially situated in the housing or housing frame and is further preferably connected thereto, for example screwed thereto. A design of the plug connector is favorable, in which the housing comprises at least one, in particular internal, spacer and/or at least one, in particular internal, bearing, which is part of the housing and with the aid of which the holding frame is held in a structurally predefined position. A corresponding spacer or a corresponding bearing is formed, for example, by a projection on the housing or on the housing frame of the housing, for example by a web or a tab. In a preferred refinement, the housing or the housing frame then includes two or four corresponding spacers or corresponding bearings, between which the holding frame is disposed, and/or on which the holding frame rests.

The aforementioned plug connector modules are furthermore disposed within the corresponding holding frame, the plug connector modules preferably being held in a form-fitting manner within the holding frame and/or are fixed on the holding frame, for example engaged therewith. The plug connector modules are typically formed from an insulating body or at least include a type of auxiliary frame, in which a number of electrical, optical, pneumatic and/or hydraulic contacts are disposed, for example contact pins and/or sockets, as well as a cable connected thereto. Depending on the application, plug connector modules in different quantities and/or different designs are then accommodated in the holding frame to implement a specially adapted plug connector.

Since the plug connector is preferably designed as a so-called modular plug connector, as explained at the outset, different plug connectors, i.e. adapted for different applications, may preferably be implemented, in that one embodiment of the holding frame is inserted into one embodiment of the housing and in that plug connectors in different quantities and/or different designs are, in particular, subsequently inserted into the holding frame. For this purpose, the corresponding plug connector modules all have the same height but possibly different lengths, a different number of contact elements and/or differently disposed contact elements.

The holding frame, in turn, preferably has a predefined depth and thus a predefined extension in the plugging direction of the plug connector as well as a rectangular cross section having two short sides of a predefined height and having two long sides of a predefined length, i.e. having a predefined extension in a longitudinal direction transversely to the plugging direction. Multiple plug connection modules having a uniform height may thus be disposed side by side in the longitudinal direction in a holding frame of this type and positioned in the holding frame. The plugging direction defines the direction in which a corresponding plug connection is to be guided in the direction of the corresponding mating plug connector to form a plug connection.

In a holding frame designed in this manner, the at least one supporting element is preferably positioned in the area of one of the two long sides of the holding frame for the support and/or reinforcement thereof. In one preferred refinement, the two long sides of the holding frame are then supported and/or reinforced in that one supporting element is disposed on each of the two long sides.

In a holding frame of this type, which has a rectangular cross section, it is furthermore advantageous if the fixing of the holding frame in the housing or in the housing frame is implemented in the area of the corners of the holding frame, and/or if the spacers and/or the supports, if corresponding supporting elements or corresponding supports are provided, are disposed in the area of the corners of the holding frame. In this case, the supporting element is then typically disposed between two spacers or bearings.

Independently thereof, the at least one supporting element is preferably positioned in the intermediate area between the housing and the holding area in such a way that it abuts the housing and/or the holding frame, in particular over a wide area. The supporting element is favorably fixed in its position, so that it is held in this position.

According to one design variant, the at least one supporting element is fixed on the holding frame, in particular in such a way that it reinforces the holding frame. This means that, in such a case, the holding frame and the supporting element are extended in the longitudinal direction, and the holding frame is reinforced by the supporting element, the ability to resist forces perpendicular to the longitudinal direction being increased. In an embodiment of this type, it is not absolutely necessary for the intermediate space between the housing and the holding frame to be completely filled in the direction perpendicular to the longitudinal direction and perpendicular to the plugging direction, but instead, in some cases, an intermediate space remains in this direction, in particular between the supporting element and the housing.

To fix the supporting element in the provided position, i.e. to fix the supporting element on the housing and/or on the holding frame, the supporting element includes, in one advantageous embodiment, a form-fitting element, for example a latching hook, with the aid of which the supporting element is engaged in the plug connector on the housing and/or on the holding frame.

Alternatively or in addition thereto, at least one supporting element is fixed in its provided position by a type of press fit, in that the supporting element is clamped, for example, between the housing and the holding frame. In this case, in particular, the supporting element fills the intermediate space between the holding frame and the housing, at least in one direction transversely to the longitudinal direction and transversely to the plugging direction, so that the holding frame is supported directly on the housing.

Regardless of whether or not the supporting element fills the intermediate space between the holding frame and the housing in the direction perpendicular to the longitudinal direction and perpendicular to the plugging direction, the supporting element is expediently adapted to the shape of the intermediate space and is preferably provided with a plate-shaped design. According to one design variant, a corresponding plate-shaped supporting element has a cross section which is tapered against the plugging direction for example to make it easier to feed the supporting element into the intermediate space during the insertion of the corresponding supporting element into the intermediate space.

If, as mentioned above, the holding frame is provided with a rectangular cross-sectional design having two short sides of a predetermined eight and having two long sides of a predetermined extension in the longitudinal direction, the at least one supporting element preferably has an extension in the longitudinal direction which corresponds to at least 20%, further preferably at least 40% and, in particular, at least 60% of the extension of one of the two long sides of the holding frame in the longitudinal direction.

According to another preferred embodiment, the holding frame has at least one contact element, which is preferably designed, in particular, as a so-called leading or first-to-make last-to-break ground contact.

Alternatively, multiple supporting elements are positioned in a cohesive intermediate space, distributed in the longitudinal direction, to thereby support the holding frame in multiple positions on the housing via the supporting elements.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
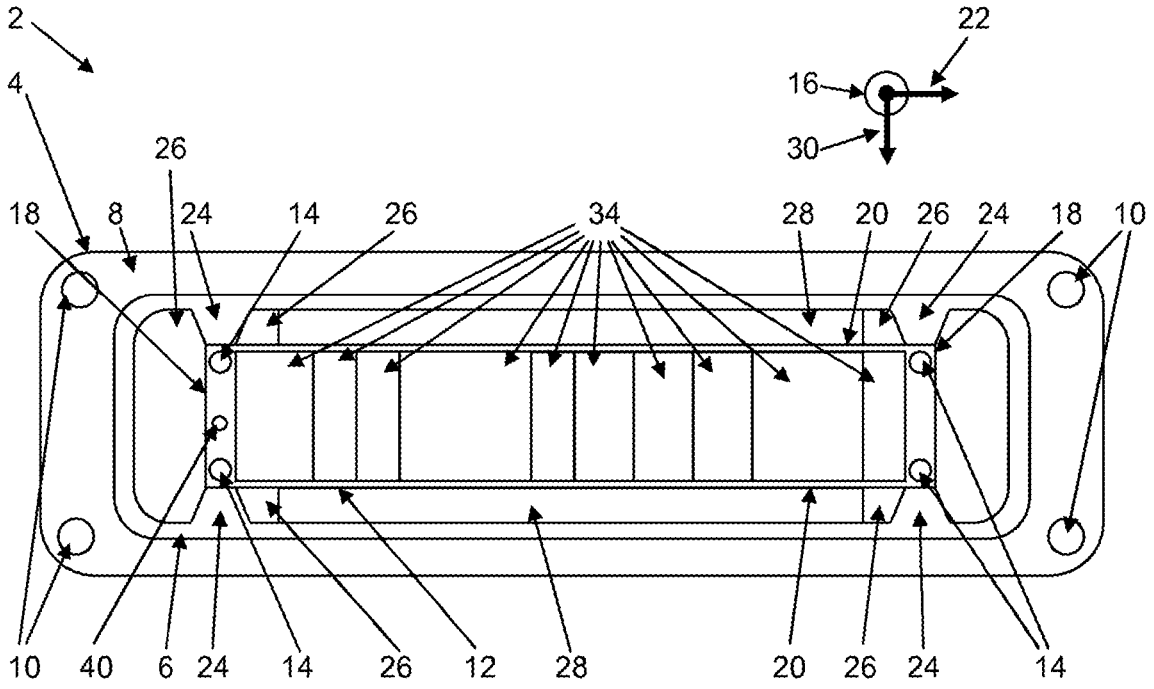
FIG. 1 shows a front view of a first embodiment of a modular plug connector.

Corresponding parts are each provided with the same reference numerals in all figures.

A plug connector 2 described by way of example below and illustrated in FIG. 1 is preferably designed as a so-called heavy plug connector 2 and also preferably as a so-called modular plug connector 2 and is configured, for example, for use in plant engineering.

Plug connector 2 comprises a housing 4, which is shown in a front view in FIG. 1. Housing 4 includes a housing frame 6, made for example from metal, as well as an outer shell 8, made for example from a plastic, outer shell 8 being designed in the exemplary embodiment as an overmolding. Alternatively, housing 4 is provided with a one-piece and one-part design and is manufactured, for example, from a plastic or from metal.

Plug connector 2 according to FIG. 1 is furthermore designed in such a way that it may be fixed on a mating plug connector, which is not illustrated, with the aid of screw connections, four screw seats 10 for four housing screws being provided for this purpose in outer shell 8 in the case of the illustrated embodiment.

A holding frame 12 is at least partially situated inside housing frame 6, which is at least partially surrounded by outer shell 8. This holding frame is also made from metal and, in the exemplary embodiment, is connected to housing frame 6 with the aid of four screw connections 14.

Holding frame 12 has a predefined depth and thus a predefined extension in a plugging direction 16, which points out of the plane of the drawing in FIG. 1, as well as a rectangular cross section having two short sides 18 of a predefined height and having two long sides 20 of a predefined length, i.e. having a predefined extension in longitudinal direction 22, which points from left to right in FIG. 1.

During the course of the installation or manufacture of plug connector 2, this holding frame 12 is inserted into housing frame 6 against plugging direction 16, housing frame 6 having four spacers 24 to define a position of holding frame 12 in housing frame 6, which are formed as webs having a trapezoidal cross section on housing frame 6 and are thus part of housing frame 6. In the exemplary embodiment, spacers 24 are used only to define a position and not to fix holding frame 12. The fixing of holding frame 12 take place after the positioning in housing frame 6 with the aid of screw connections 14, which are disposed in the area of the corners of holding frame 12. Alternatively, housing 4 or housing frame 6 includes spacers 24 and/or bearings, which are used to define a position and to fix holding frame 12. In such a case, holding frame 12 is then screwed to spacers 24 and/or to the bearings, for example with the aid of screws.

Spacers 24 according to FIG. 1 are furthermore also disposed in area of the corners of holding frame 12 in the fixed state of holding frame 12, an intermediate area 26 or clearance existing in each case between two spacers 24 as well as between the rest of housing frame 6 and holding frame 12. In the exemplary embodiment, one supporting element 28 is disposed in each of the two intermediate spaces or intermediate areas 26 adjacent to long sides 20 of holding frame 12.

Each of the two supporting elements 28 fills corresponding intermediate area 26 at least in transverse direction 30 transversely to plugging direction 16 and transversely to longitudinal direction 22, so that holding frame 12 is supported by particular supporting element 28 on housing frame 6. This avoids a critical deformation of holding frame 12, in particular due to forces in transverse direction 30. Supporting elements 28 are provided with a plate-shaped design in the exemplary embodiment and abut holding frame 12, on the one hand, and housing frame 6, on the other hand, over a wide area.

Figure 2:
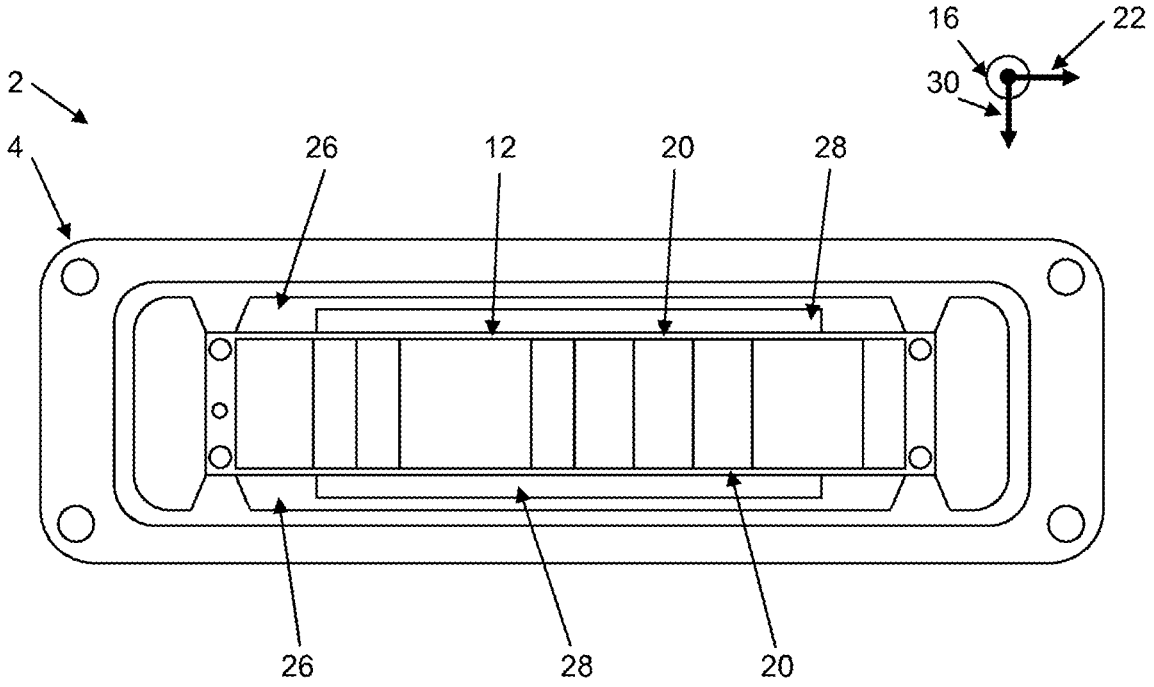
FIG. 2 shows a front view of a second embodiment of a modular plug connector.

An alternative embodiment of supporting elements 28 is shown in FIG. 2. In this case, supporting elements 28, which are disposed in the same intermediate area 26, abut only holding frame 12. However, a clearance continues to exist between supporting elements 28 and housing frame 6, and holding frame 12 is therefore not directly supported on housing frame 6 in this case, Instead, supporting elements 28 in this exemplary embodiment are used primarily to reinforce holding frame 12 and, in particular, long sides 20 of holding frame 12, for this purpose supporting elements 28 abutting holding frame 12 over a wide area, on the one hand, and being fixed on holding frame 12, on the other hand.

Figure 4:
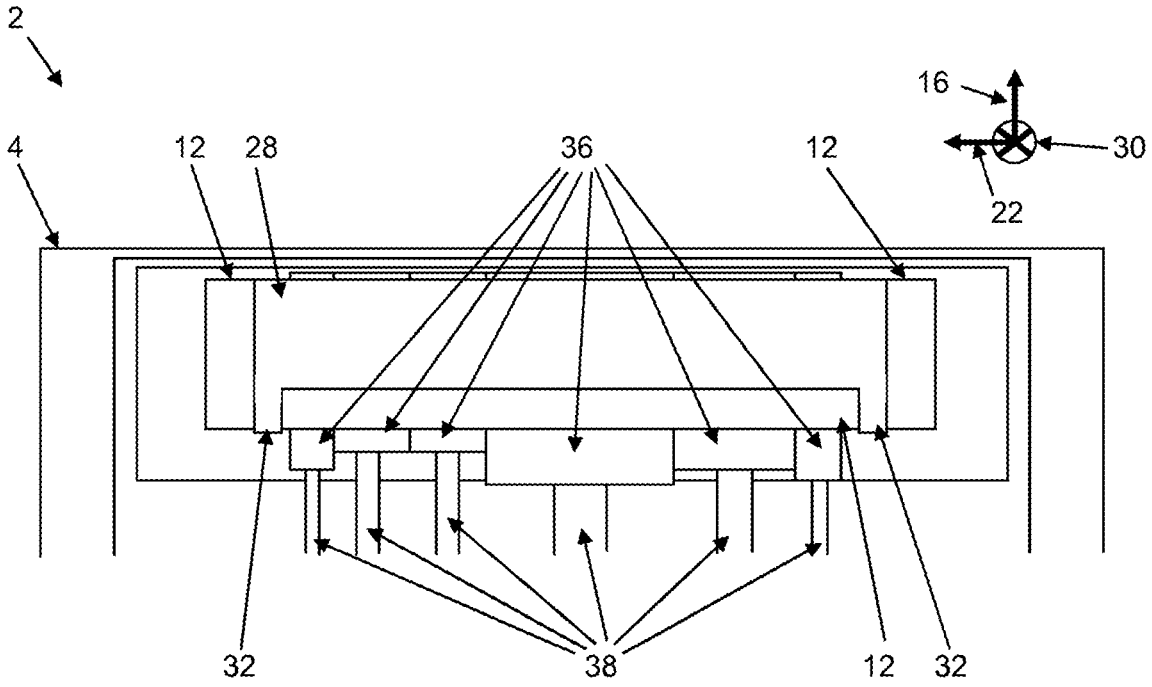
FIG. 4 shows a partial sectional representation of the first embodiment of the modular plug connector.

In the exemplary embodiment, the fixing on holding frame 12 takes place with the aid of two latching hooks 32, which are indicated in FIG. 4. In this partial sectional representation, longitudinal direction 22 points from right to left, and plugging direction 16 points up. Based on this partial sectional representation according to FIG. 4, a corresponding supporting element 28 is inserted into corresponding intermediate area 26 from top to bottom until latching hooks 32 engage the lower end of holding frame 12, from behind, whereby corresponding supporting element 28 engages on holding frame 12. Otherwise, the embodiment of plug connector 2 according to FIG. 2 corresponds to the embodiment according to FIG. 1.

Figure 3:
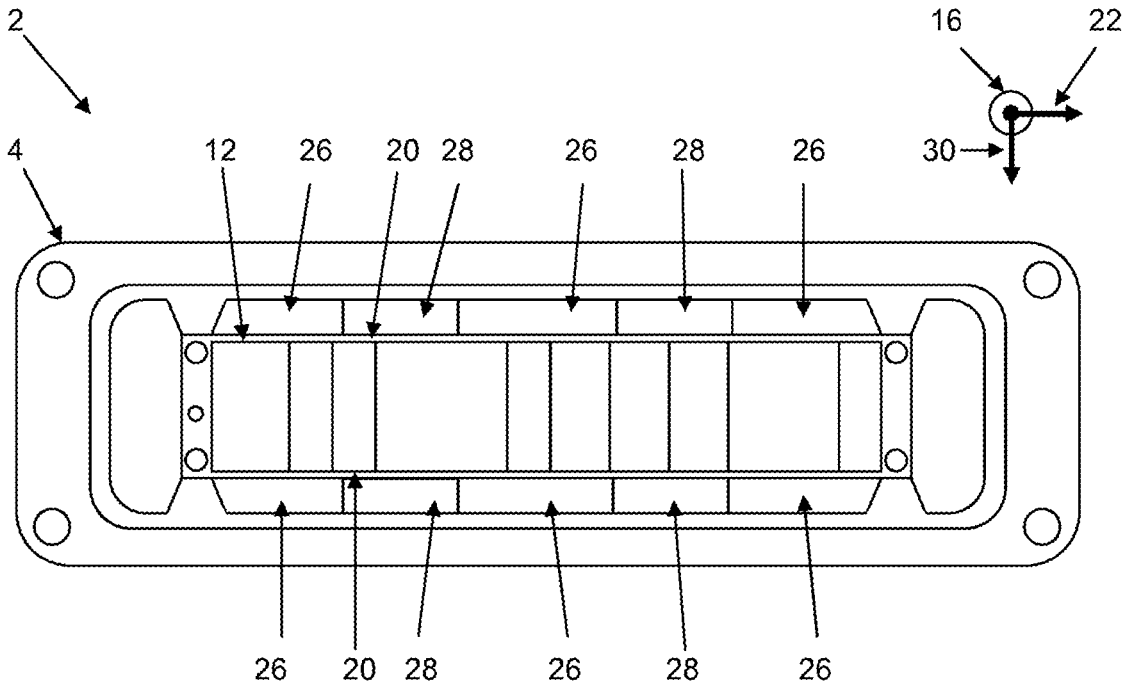
FIG. 3 shows a front view of a third embodiment of a modular plug connector.

Another alternative embodiment of plug connector 2 is illustrated in FIG. 3, in this case, four supporting elements 28 being used, which serve to support holding frame 12 on housing from 6 as in the exemplary embodiment according to FIG. 1. However, supporting elements 28 in this exemplary embodiment have a smaller extension in longitudinal direction 22, for which reason multiple supporting elements 28 are used for each intermediate space or intermediate area 26. The latter are then disposed, distributed in longitudinal direction 22, so that holding frame 12 is supported in multiple positions on housing frame 6. Supporting elements 28 are fixed by a press fit, and these supporting elements 28 therefore do not have any latching hooks 32. Otherwise, the embodiment of plug connector 2 according to FIG. 3 again corresponds to the embodiment according to FIG. 1.

Figure 5:
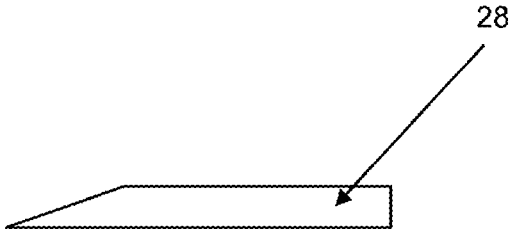
FIG. 5 shows a cross-sectional representation of an embodiment of a supporting element.

Regardless of the extension of a corresponding supporting element 28 in longitudinal direction 22, it is preferably provided with a plate-shaped design and is also preferably manufactured from a plastic. The geometry of a corresponding supporting element 28 is expediently adapted to the geometry of corresponding intermediate area 26. According to another advantageous embodiment of a corresponding supporting element 28, the latter has a cross section which tapers against plugging direction 16, as illustrated by way of example in FIG. 5. Due to a pointed trapezoidal shape of this type, a corresponding supporting element 28 may be more easily inserted or fed into a corresponding intermediate area 26, which makes it easier to install or retrofit a corresponding plug connector 2.

Holding frame 12 of plug connector 2 is used to receive plug connector modules 34. The assembly of plug connector 2 preferably takes place in such a way that all provided plug connector modules 34 are first inserted into holding frame 12 and preferably also fixed on holding frame 12, for example engaged therewith, before supporting elements 28 are inserted into intermediate areas 26. Corresponding supporting elements 28 may, in principle, also be introduced later on into plug connectors 2 having corresponding intermediate areas 26 for the purpose of retrofitting corresponding plug connectors 2.

Depending on the application, a corresponding plug connector 2 may include plug connector modules 34 in different quantities and/or different designs, all plug connector modules 34 having a uniform height in the case of the exemplary embodiment described here. However, plug connector modules 34 differ with regard to the extension in longitudinal direction 22 as well as with regard to the number and/or design and/or arrangement of the electrical contacts, via which the electrical signals and/or electrical power is/are transmittable from plug connector 2 to a corresponding mating plug connector.

According to one design variant, plug connector modules 34 have uniformly designed electrical contacts, which are designed, in particular, as contact pins. In this case, plug connector modules 34 differ only with regard to the extension in longitudinal direction 22, with regard to the number of electrical contacts and with regard to the arrangement of the electrical contacts. Each plug connector module 34 includes an auxiliary frame 36, in which the electrical contacts, which are not illustrated, are disposed, as well as a cable 38 connected to auxiliary frame 36.

Holding frame 12 in the exemplary embodiment is also manufactured from metal and has a contact element 40, which is designed as a so-called leading or first-to-make last-to-break ground contact. Alternatively, holding frame 12 has a corresponding contact element 40 in the area of each short side 18, one of these contact elements 40 being designed, for example, as a contact pin and the other as a socket.

The invention is not limited to the exemplary embodiment described above. Instead, other variants of the invention may be derived herefrom by those skilled in the art without going beyond the subject matter of the invention. Moreover, in particular, all individual features described in connection with the exemplary embodiment may also be otherwise combined with each other without going beyond the subject matter of the invention.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A plug connector comprising:

a housing, a holding frame, which is situated at least partially inside the housing and is fastened thereto, a number of plug connector modules, which are held in the holding frame, and at least one separate supporting element being disposed in an intermediate area between the housing and the holding frame, the at least one separate supporting element supporting the holding frame and protecting the holding frame against a critical deformation, wherein the holding frame has a rectangular cross-section having two short sides connected between two long sides, wherein the at least one separate support element is disposed on and directly abuts one of the two long sides of the holding frame, such that the at least one separate supporting element is disposed between the one of the two long sides of the holding frame and an inner surface of the housing that opposes the one of the two long sides of the holding frame, wherein the housing includes at least two spacers to hold the holding frame in a predefined position, the at least two spacers being monolithic with the housing and directly abutting the one of the two long sides of the holding frame, and the at least two spacers being spaced apart from one another with the at least one separate supporting element being positioned between the at least two spacers.

2. The plug connector according to claim 1, wherein the at least one separate supporting element abuts the housing and/or the holding frame.

3. The plug connector according to claim 1, wherein the at least one separate supporting element is fixed on the holding frame to reinforce the holding frame.

4. The plug connector according to claim 1, wherein the at least one separate supporting element includes at least one form-fitting element for fixing on the housing and/or on the holding frame.

5. The plug connector according to claim 1, wherein the at least one separate supporting element is clamped between the housing and the holding frame.

6. The plug connector according to claim 1, wherein the at least one separate supporting element has a plate-shaped design.

7. The plug connector according to claim 1, wherein the two short sides of the holding frame have a predetermined height and the two long sides have a predetermined extension in the longitudinal direction, and wherein the at least one separate supporting element has an extension in the longitudinal direction which corresponds to at least 20% of the extension of one of the two long sides of the holding frame in the longitudinal direction.

8. The plug connector according to claim 1, wherein the at least one separate supporting element is manufactured from plastic.

9. The plug connector according to claim 1, wherein the at least one separate supporting element has an extension in the longitudinal direction which corresponds to at least 60% of the extension of one of the two long sides of the holding frame in the longitudinal direction.

10. The plug connector according to claim 1, wherein a height of the at least one separate supporting element is smaller than a distance between the inner surface of the housing and the one of the two long sides of the holding frame, such that the at least one separate supporting element is spaced apart from the inner surface of the housing that opposes the one of the two long sides of the holding frame when the at least one separate supporting element directly abuts the one of the two long sides of the holding frame.

11. A method for manufacturing a plug connector comprising a housing as well as comprising a holding frame, which is at least partially situated inside the housing and is fastened thereto and the holding frame having a rectangular cross-section with two short sides and two long sides, a number of plug connector modules being inserted into the holding frame, so that the number of plug connector modules are subsequently held in the holding frame, and a separate supporting element being subsequently introduced into an intermediate area between the housing and the holding frame and fixed therein, the separate supporting element being introduced between at least two spacers of the housing that are spaced apart from one another, the at least two spacers being monolithic with the housing and provided to hold the holding frame in a predefined position by directly abutting one of the two long sides of the holding frame, and the separate supporting element being introduced so as to be disposed on and directly abut the one of the two long sides of the holding frame, such that the separate supporting element is disposed between the one of the two long sides of the holding frame and an inner surface of the housing that opposes the one of the two long sides of the holding frame.

* * * * *